United States Patent [19]

Fellnor et al.

[11] 3,985,497

[45] Oct. 12, 1976

[54] SCRAP PREHEATING SYSTEM

[75] Inventors: John R. Fellnor, Yardley, Pa.; Thomas J. Dzakowic, Delran, N.J.

[73] Assignee: Melting Systems, Inc., Burlington, N.J.

[22] Filed: Nov. 21, 1974

[21] Appl. No.: 525,838

[52] U.S. Cl. ..... 432/72; 432/192; 432/146; 432/134; 266/901; 75/44 S

[51] Int. Cl.[2] ..... F27D 3/06

[58] Field of Search ..... 432/11, 13, 21, 72, 432/123, 134, 137, 138, 143, 145, 156, 153, 192, 150, 169, 266, 500; 266/33 S; 75/44 S

[56] References Cited

UNITED STATES PATENTS

| | | | |
|---|---|---|---|
| 225,598 | 3/1880 | Heafer et al. | 432/192 |
| 1,403,734 | 1/1922 | Booth | 432/137 |
| 1,646,208 | 10/1927 | Meehan | 432/137 |
| 1,896,910 | 2/1933 | Merkt | 432/21 |
| 2,191,438 | 2/1940 | Breeler | 432/137 |
| 3,412,985 | 11/1968 | Perry et al. | 432/72 |
| 3,758,267 | 9/1973 | Berk | 432/134 |
| 3,762,858 | 10/1973 | Torrence | 432/266 |
| 3,813,209 | 5/1974 | Venetta | 432/134 |
| 3,839,016 | 10/1974 | Rawlings | 266/33 S |
| 3,854,865 | 12/1974 | Fay | 432/146 |

*Primary Examiner*—John J. Camby
*Assistant Examiner*—Henry C. Yuen
*Attorney, Agent, or Firm*—Charles F. Duffield

[57] ABSTRACT

A scrap preheating system of the type employing a conveyor upon which the scrap is placed, an elongate burner hood surrounding the conveyor and burners within the hood which direct flames upon the scrap. The side walls of the burner hood include an elongate exhaust chamber and side wall ports between the exhaust chamber and the interior of the hood. An exhaust fan induces a negative pressure under the hood through the exhaust chambers which pulls the unburned hydrocarbons from under the hood through the side wall ports into the exhaust chamber. Additionally, air is drawn upwardly between the conveyor and side walls of the hood and through the side wall ports into the exhaust chambers wherein combustion is completed and pollution reduced. The length of hood and burner array exceeds the length of scrap material on the conveyor. The conveyor is periodically jogged during the preheating cycle to slightly advance and mix the scrap and only those burners positioned above the scrap are operated as it advances. The burners are initially operated with a slightly oxidizing flame until hydrocarbons are burned from the scrap and thereafter operated with a slightly reducing flame to prevent significant oxidation of the metal.

7 Claims, 5 Drawing Figures

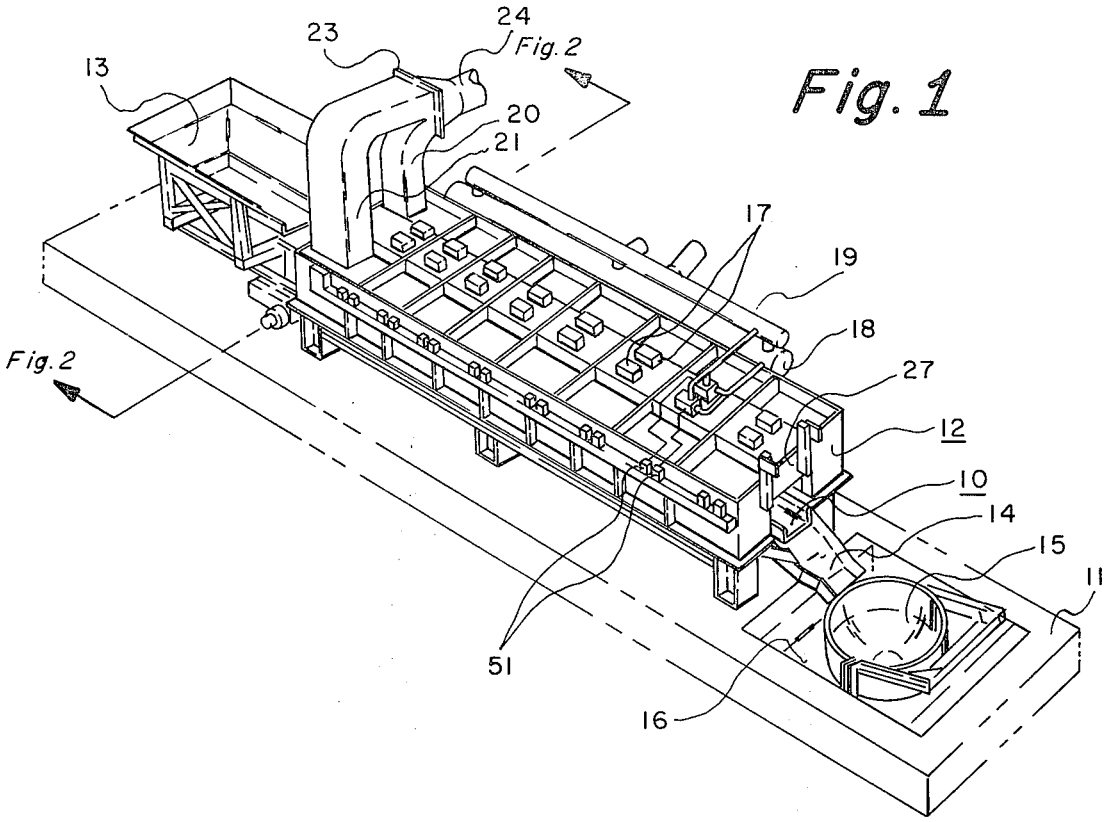
Fig. 1
13
23
24
Fig. 2
20
21
17
19
18
27
12
10
14
15
11
16
51
Fig. 2
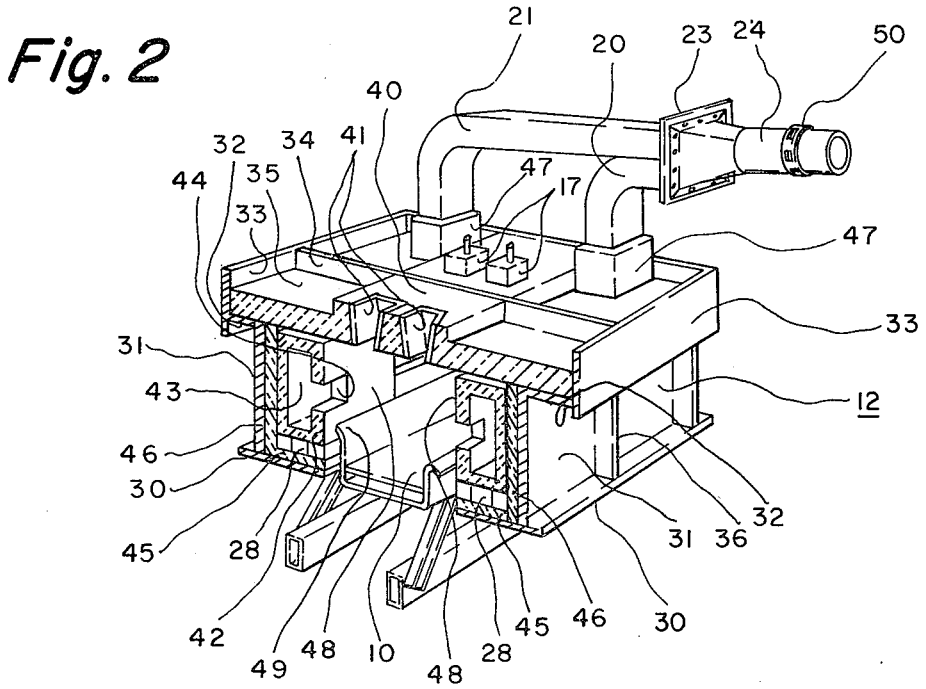
Fig. 2
21
20
23
24
50
40
32
34
41
44
35
33
47
17
47
33
31
43
12
46
30
45
28
42
49
48
10
48
28
45
46
30
31
36
32

SCRAP PREHEATING SYSTEM

BACKGROUND OF INVENTION

In various industries, such as the foundary industry and the production of cast iron and steel, it is customary to charge a furnace with scrap metal. In foundaries the scrap metal is almost entirely the source of raw material employed to obtain the casting metal. In the basic iron and steel industry, great quantities of scrap are employed in the furnaces in combination with iron ore.

The type of scrap material used may take various forms. One source of scrap is such items as sheet shearings, punchings, turnings, chips, gates, risers and scraped castings. Other sources of scrap, which have become of increasing use, are scrap automotive parts such as shattered engine blocks, transmissions and differentials.

One of the problems in using scrap is the presence of various contaminants such as oil and grease, especially in the automotive scrap. Where the scrap has been stored outdoors, there will be entrapped moisture present in the scrap. It is undesirable to charge such contaminated scrap into a furnace since the entrapped moisture and other readily vaporizable material, such as grease, will expand rapidly in the furnace with the effect of an explosion. In addition, grease and oil which does not vaporize immediately, can result in contamination of the molten metal.

Charging of cold scrap into a furnace will increase the time for the batch to reach pouring temperature as well as the load on the furnace as compared to preheated scrap. Thus, many foundaries desire preheating scrap to improve furnace output and efficiency.

For the foregoing reasons, various types of equipment have been developed for the purpose of preheating scrap and removing moisture and grease or oil from the scrap. One such type of equipment is a preheater which employs an elongate conveyor which passes scrap under a hood. The hood includes a plurality of burners that direct flames upon the scrap metal on the conveyor to burn off the moisture and grease and preheat the scrap.

One of the problems encountered in metal preheating systems of this type is the pollution in the form of smoke and unburned hydrocarbons which result from operation of the system. One way in which to reduce the amount of unburned hydrocarbons is to permit an excess of air under the hood beyond that needed for the burner flame to aid in complete burning of the grease and oil on the scrap. This could be accomplished by operating the burners with an excess of air or by permitting outside air to enter under the hood. However, the presence of excess air under the hood results in oxidation of metal which is undesirable.

As a result of the oxidation problem, preheating systems of the hood type are generally operated with a reducing atmosphere. The resultant heavy concentration of unburned hydrocarbons are permitted to escape to the atmosphere in some cases. In other cases, they are vented from the furnace and after burners are used to clean up the pollutants in the exhaust gases.

Another problem encountered in the present conveyor-hood type preheating systems is the uneven preheating of the scrap. The thickness of the bed of scrap can vary along the conveyor. Additionally, the spacing of the burners, by necessity, must be spread out along the hood. As a result, the flames from the burners will impinge more directly upon the scrap directly beneath the burners than on the scrap between adjacent burners. Further yet, the flames from the burners only strike the top surfaces of the scrap. The sides and underneath portions of the scrap as well as that positioned deeply in the bed are not engaged as directly by the flames from the burners resulting in less uniform heating and contaminants thereon being removed to a lesser degree.

OBJECTS AND SUMMARY OF INVENTION

It is an object of the present invention to provide a scrap preheating system of the conveyor-hood type which includes structure within the hood itself for complete combustion of unburned hydrocarbons.

It is a further object of the present invention to provide a preheating system which further reduces the presence of unburned hydrocarbons through control adjustment of the burner mixture throughout the preheating cycle between an initial oxidizing flame to a reducing flame.

It is a further object of the present invention to provide a scrap preheating system which will permit direct contact of the burner flames with all of the scrap through coordination of the operation of the conveyor and burners through the preheating cycle.

The foregoing objects are carried out in the preheating system of the present invention which includes a conveyor-burner hood preheater in which two elongate exhaust chambers formed in the side walls of the burner hood. The exhaust chambers communicate with the interior of the hood through a plurality of side wall ports positioned in the inner walls of the side walls of the hood. Doors are provided at the charging and discharging ends of the hood. A negative pressure is drawn under the hood and within the exhaust chambers by means of an exhaust fan and duct work system in communication with the exhaust chambers. The gases under the hood are drawn into and through the exhaust chambers by the exhaust fan.

The inner side walls are spaced slightly from the sides of the conveyor. The negative pressure within the exhaust chambers draws air upwardly between the conveyor and side walls and through the side wall ports into the exhaust chambers without contacting the preheated scrap. The air combines with the unburned hydrocarbons in the exhaust chambers and complete combustion of the unburned hydrocarbons takes place.

Further in accordance with the present invention, the burners are controlled such that, upon initial operation, the air to fuel mixture in the burners provides a slightly oxidizing atmosphere within the hood. This slightly oxidizing atmosphere aids in more complete combustion of the contaminants on the scrap and is maintained until the scrap approaches a temperature at which significant oxidation would take place. Thereafter, the burners are automatically cycled to an air to fuel ratio which is slightly reducing to prevent oxidation.

The preheating system of the present invention also includes controls for loading the conveyor with a bed of scrap of length less than the hood length. The conveyor is operated briefly during the preheating cycle, at predetermined intervals, to shift the bed of scrap toward the discharge end of the conveyor and remix the scrap to present different surfaces of the scrap to the burner flames. Additionally, the burners are cycled such that only those burners directly above the bed of scrap operate as the scrap progressively moves toward the discharge end of the conveyor.

Other objects and advantages of the present invention will become apparent to those skilled in the art from the detailed description thereof which follows taken in conjunction with the drawings.

DESCRIPTION OF DRAWINGS

FIG. 1 is a perspective view of the scrap preheating system of the present invention;

FIG. 2 is a perspective view, partially in section, of a portion of the preheating system of FIG. 1;

DETAILED DESCRIPTION OF INVENTION

Figure 3:
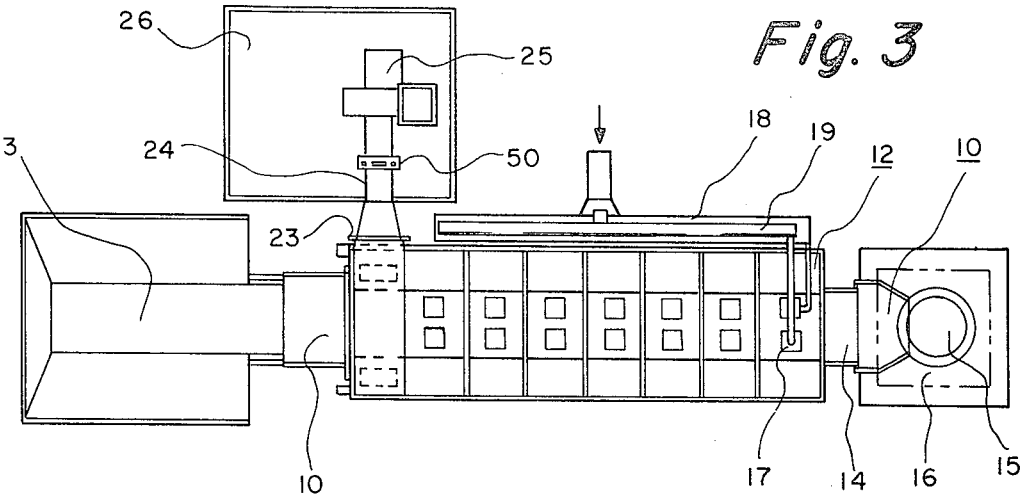
FIG. 3 is a plan view of the scrap preheating system of FIG. 1.

The overall scrap preheating system of the present invention is shown in FIGS. 1 and 3 of the drawings. The system includes a vibratory conveyor 10 which is suitably supported upon a concrete supporting pad 11. The conveyor may be of any suitable type but preferably is of the vibratory type. A burner hood 12 is supported over top of the conveyor 10 and extends just short of both ends of the conveyor. The system further includes a weighing scale and conveyor 13 at the charging end of the preheating system. A discharge chute 14 is provided at the discharge end of the conveyor and is in alignment with a charging bucket 15 disposed in a recessed well 16 in the concrete supporting pad.

A plurality of high velocity burners 17 (only 2 shown) are positioned to parallel rows along the top of the burner hood 12. Air is supplied to the burners 17 by means of conduits leading from an air manifold 18. In a like manner, gas is supplied to the burners by means of conduits from a common gas manifold 19. The type of burner used and its operation are of a standard type commonly used in preheating systems for scrap metal and, therefore, it is not believed necessary for the purposes of the present invention to describe these burners and their operation in detail. One form of burner which may be utilized in the present invention is a burner manufactured by North American Manufacturing Company and given the type designation of "Tempest" burner.

Two vertical exhaust ducts 20 and 21 are provided at the charging end of the burner hood. The two exhaust ducts join at a flange 23 and form a single duct 24. Ducts 20 and 21 are used to exhaust the combustion products and unburned hydrocarbons from the hood in a manner to be described in more detail hereinafter. The exhaust draft is created by an exhaust fan 25 whose intake is connected to duct 24 as shown in FIG. 3. The exhaust fan 25 is ducted to the roof of the building housing the preheating assembly. The exhaust fan 25 is supported upon a supporting platform 26 positioned above the burner hood.

Before proceeding with a description of the details of the preheating system of the present invention, it is believed appropriate to discuss the general overall operation of a preheating system of the type involved. In general operation, scrap to be preheated is loaded in the scales and conveyor 13 until a predetermined amount of scrap has so been deposited. Thereupon, the conveyor, which forms the bottom of the scale 13, is operated to distribute the scrap onto the end of the preheating conveyor 10 which is operated as the scrap is unloaded from the scales 13. In this manner, an even bed of scrap is distributed upon the conveyor 10. The rate of transfer of the scrap from the scales 13 and the rate of movement thereof along the preheating conveyor 10 is so adjusted that the total of the scrap in the scales 13 will be evenly distributed along the length of the conveyor 10.

Once the scrap is positioned underneath the hood, doors 27 on either end of the hood are closed. Thereafter, the burners are turned on and the flames from the burners directly impinge upon the scrap metal on the conveyor. After a predetermined time, in which the hydrocarbons are burned from the scrap and it preheated to the required temperature, the burners are shut off. Thereupon, the doors are opened and the conveyor 10 operated to convey the preheated scrap from the conveyor 10 down a chute 14 into the charging bucket 15. The preheated scrap is then delivered, by means of the charging bucket 15, to the furnace into which it is loaded.

Figure 4:
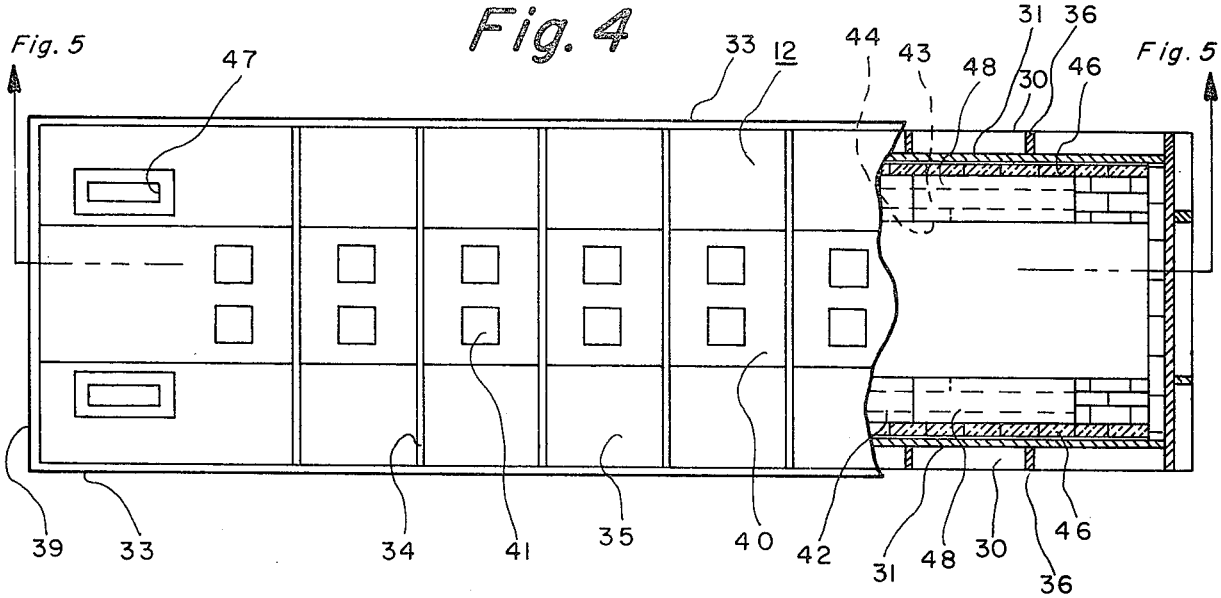
FIG. 4 is a plan view, partially in section, of the hood of the preheating system of the present invention.
Figure 5:
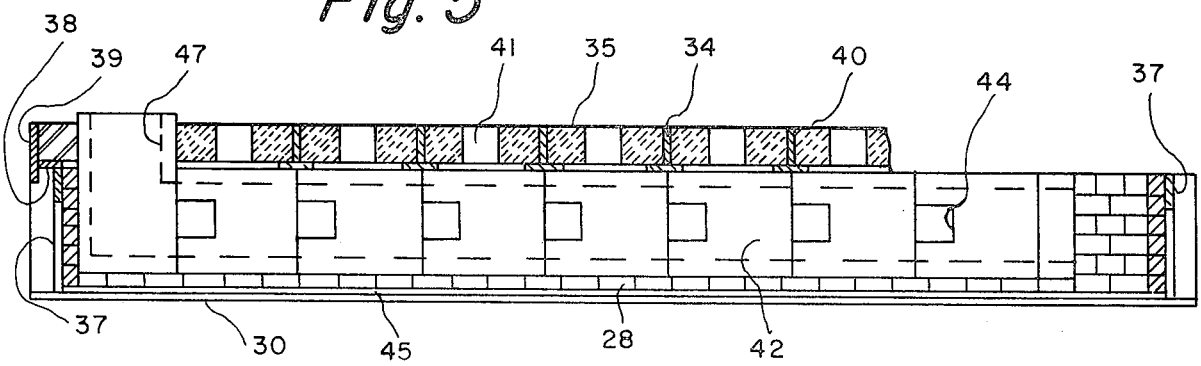
FIG. 5 is a cross-sectional view of the hood of the preheating system of the present invention.

The details of the burner hood of the present invention are shown in FIGS. 2 and 4–5 of the drawings. The burner assembly includes a structural framework which includes two parallel bottom plates 30 which run the entire length of the burner hood. Two parallel outer side walls 31 are welded to the bottom plates 30 toward the outer edges of the bottom plates to provide a shelf upon which the exhaust chambers will rest as to be described hereinafter. The upper ends of the outer side walls 31 have welded thereto an upper flange 32 which likewise extends for the entire length of the burner hood.

The upper flanges 32 have welded thereto side panels 33 which extend above the flange 32 and likewise extend for the entire length of the burner hood. A plurality of T shaped reinforcing members 34 (best seen in FIG. 5) are welded between the side panels 33, at intervals, to compartmentalize the upper portion of the reinforcing structure to support refractory cover members 35 as hereinafter described. A plurality of side reinforcing members 36 are appropriately spaced along the side walls 31 and welded to the side walls, bottom plates 30 and upper flanges 32 as reinforcement.

The charging and discharging ends of the burner hood, as best seen in FIG. 5, likewise include end walls 37 which are welded in place to the bottom plates 30. The end walls 37 each include an opening in the lower portion thereof through which the conveyor 10 passes. The upper portion of each end wall 37 is welded to an upper end flange 38 to which, in turn, there is welded an upwardly extending upper end side panel 39 similar to the structure of the side walls.

The burner hood assembly includes a plurality of precast covers 35 which are formed of a refractory material. The covers are of a length and width equal to the compartments formed by the upper side panels 33 and reinforcing members 34. Each cover is adapted to drop into place into the compartment formed by these members and rest upon the flanges of the T shaped reinforcing members 34 and the upper flanges 32 as best seen in FIG. 2.

Each precast cover member 35 includes a raised pad 40. Two burner apertures 41 are formed into each pad 40. The burners 17 are designed to fit within the apertures 41 and extend into the burner hood above the conveyor 10.

The outer side walls 31 and bottom plates 30 provide the support for a plurality of flue tiles 42 which are positioned in end to end relationship as seen in FIGS. 4 and 5. Each flue tile includes an internal exhaust chamber 43 running through the tile such that the tiles, in place, will form a continuous exhaust chamber throughout the length of the burner hood. Each flue tile 42 includes a side wall port 44 therein for the purpose hereinafter described.

Each flue tile 42 is positioned upon a layer of refractory brick 28. The refractory brick 28, in turn, is positioned upon a layer of refractory insulating material 45 which rests upon the upper surface of the bottom plate 30. In a like manner, the outer side walls of the flue tile 42 are insulated from the metal side walls 31 by means of a layer of refractory insulating material 46.

The last flue tile at the discharge end of the burner hood is formed with an upwardly extending stack 47. The discharge ducts 20 and 21 are connected to the stacks 47 as shown in FIG. 2.

The inside walls 48 of the flue tile, facing one another, are spaced apart a distance to provide a small clearance between the side walls 48 of the flue tile and the upper edge 49 of the conveyor 10. Additionally, the upper edge 49 of the conveyor is supported in position at a point slightly below the lower edge of the side wall ports 44 as shown in FIG. 2.

In operation, the discharge fan 25 will induce a negative pressure in the exhaust chambers 43 through ducts 20 and 21. The negative pressure in the exhaust chambers will, in turn, draw the products of combustion including unburned hydrocarbons formed under the hood into the exhaust chambers through the side wall ports 44.

The negative pressure under the hood likewise results in air being drawn upwardly through the space between the side walls 48 of the flue tile and the outer upper edges 49 of the conveyor. The air passing between the conveyor and side walls of the flue tile will enter the side wall ports 44 and exhaust chambers 43 but will not engage the scrap. The air entering the exhaust chambers mixes with the unburned hydrocarbons being drawn from under the hood. The gases being drawn from under the hood are extremely hot and, upon mixing with the air containing unburned oxygen, reignite in the exhaust chambers and combustion of the unburned hydrocarbons is completed.

It will be appreciated that, with the exhaust chambers, the atmosphere under the hood, in the vicinity of the scrap, can be maintained in a reducing atmosphere to thus prevent oxidation of the scrap while, at the same time, the unburned hydrocarbons are immediately subjected to an oxidizing atmosphere in the exhaust chambers when mixed with the air drawn between the side walls and the conveyor. Thus, the exhaust chamber arrangement presents the advantages of both a nonoxidizing atmosphere surrounding the scrap metal and an oxidizing atmosphere immediately adjacent the conveyor for complete combustion of the hydrocarbons.

The discharge chamber arrangement also has a further advantage. The air being drawn between the side walls of the flue tile and the conveyor serves to cool the underside of the conveyor. With this cooling effect, greater temperatures can be generated on top of the scrap for more efficient preheating.

The exhaust gases leaving the exhaust chambers through ducts 20 and 21 will be extremely hot. These hot gases may present a danger of overheating of the discharge fan 25. Protection for the discharge fan 25 is provided by means of an air bleed diffuser ring 50 positioned in duct 24, in advance of the discharge fan. The diffuser ring, shown in FIG. 2, comprises an annular ring disposed around the duct 24 which includes a plurality of arcuate slots in the ring. A corresponding plurality of arcuate slots in duct 24 are provided. The annular adjustment of the diffuser ring 50 with respect to the duct 24 provides greater or less alignment of the arcuate slots thus increasing or decreasing the amount of air that is permitted to be bled into the duct 24. The diffuser ring 50 is adjusted to permit sufficient air to be bled into the duct as necessary to reduce the temperatures of the gas to a level which can be tolerated by the exhaust fan 25.

The scrap preheating system of the present invention further includes structure and control means to assure that the entire length of the scrap bed is exposed to the direct flames from the burners and also that the scrap is agitated or mixed on the conveyor such that all surfaces of the scrap are presented to the burner flames. In this respect, it is to be noted that the parallel rows of burners 17 extend substantially throughout the entire length of the burner hood. Each of the burners 17 include air and gas shut off valves which are electrically operated so that individual burners may be turned on or off independently of the other burners. Control of the burners are accomplished by timing relays 51, as best seen in FIG. 1.

At the beginning of a preheating cycle, a quantity of scrap is loaded onto the charging end of conveyor 10 to form a bed of scrap of length less than the total length of the conveyor. Thereafter, the burners positioned directly over this bed of scrap are turned on and those burners toward the discharge end of the conveyor, under which the scrap has not yet been positioned, are not turned on.

After a predetermined time interval, a timer associated with the conveyor initiates operation of the conveyor for a very brief interval. During this interval, the scrap on the conveyor will be advanced a short distance toward the discharging end of the conveyor. This advancement results in repositioning of the scrap bed with respect to the burners and also mixes the scrap presenting new surfaces of the scrap to direct impingement by the burner flames.

The control relays 51 controlling the burners 17 are interconnected with the timer operating the conveyor. The timer operating the conveyor is so constructed that each time it causes a cycling of the conveyor to advance the scrap, the timer also follows a predetermined pattern to discontinue operation of those burners on the charging end of the conveyor which the scrap bed has cleared and initiate operation of those burners under which the scrap has advanced such that only those burners above the shifted scrap bed are on. This sequence continues through several cycles until the entire bed of scrap has been progressively advanced to the discharge end of the conveyor at which time the last row of burners at the discharge end of the hood will be turned on and several rows at the charging end thereof turned off thus avoiding direct engagement of the flames with the conveyor. At this point, the preheat cycle has reached an end whereupon all of the burners are turned off, the discharge door 27 opened and the scrap advanced off of the conveyor into the charging bucket 15.

Further in accordance with the present invention, the burners 17 and control means therefor are designed to operate in a manner to remove as much of the grease and other contaminants from the scrap metal as possible without generation of excess hydrocarbons while avoiding significant oxidation of the metal. This is accomplished by utilizing valves on the air and fuel inlets for each of the burners which are capable of being actuated to by control relays 51 to different degrees of open position. At the start of the preheat cycle when the burners are turned on, the main cycle timer for the apparatus (not shown) will set the control relays 51 in a manner to set the air to fuel ratio for the burners at a slightly oxidizing ratio.

At start up, the scrap is cold and, of course, the grease concentration on the scrap the heaviest. An excess of oxygen is required beyond that to sustain the burner flame to complete combustion of the grease. Accordingly, the excess air to fuel ratio or oxidizing atmosphere generated by the burners during the initial phase of the preheat cycle supplies the necessary oxygen to result in more thorough combustion of the grease and oil on the scrap. No significant oxidation will occur on the scrap during this initial phase since the grease will not have been burned sufficiently from the scrap to present the bare metal for oxidation nor will the scrap have reached a temperature at which oxidation will occur to any significant degree.

After a predetermined time, at which the temperature of the scrap has become elevated to a point at which oxidation starts to become significant, the main cycle timer then resets relays 51 to adjust the air to fuel ratio of the burners 17 to a slightly reducing atmosphere. In this manner, excess oxygen has been provided, when most required, during the initial phase of the preheat cycle to burn the oil and grease without significant oxidation while the remainder of the cycle is in a reducing atmosphere during the portion of the preheat cycle in which oxidation could occur. Any unburned hydrocarbons which were not consumed during either the initial phase or subsequent phase of the preheat cycle will be completely burned in the discharge tubes as earlier described.

In a typical embodiment of the preheating system of the present invention, the conveyor 10 is 31 feet in length and 4 feet wide. The burner hood 12 is 25 feet in length. The spacing between the sides 49 of the conveyor and the side walls 48 of the flue tile is 1 ½ inches. The height between the surface of the conveyor 10 and the under surface of the cover 35 is approximately 24 inches.

The discharge chambers 46 in the flue tiles 32 are approximately 6 inches in width by 18 inches in height and the discharge chambers extend for approximately 20 feet through the side walls of the hood. The side wall ports 44 number 20 to a side and are approximately 6 inches square. The insulating brick 44 and the bottom and side wall insulation 45 and 46 respectively are all approximately 3 inches in thickness.

A typical production rate for the preheater is 13 tons of scrap metal per hour. The preheat cycle time is approximately 10 minutes. At the end of this cycle, the scrap reaches a temperature of approximately 1200° F. The temperature within the exhaust chambers is within the range of from 1400° to 1500° F.

The fuel for the preheater is natural gas mixed with air drawn from the atmosphere. A typical output for the preheater will be in the range of 17,000,000 BTU's.

The exhaust fan 25 draws a negative pressure under the hood of approximately one-eighth inch of water. The displacement of combustion products drawn from under the hood, by the discharge fan 25, is approximately 11,000 cubic feet per minute.

The initial phase of the preheating cycle, during which the burners are set slightly oxidizing, is of approximately 3 minutes duration. During this phase, the burners are set approximately 5% rich in oxygen. The remainder of the preheating phase is approximately 7 minutes during which the burners are reset to approximately 5% rich on gas.

Cycling of the conveyor to advance the scrap for different burner positioning and to agitate the scrap for different surface exposure is accomplished in three second conveyor operations. The bed of scrap on the conveyor is advanced toward the discharge end of the conveyor approximately 2 feet with each agitation cycle. In a typical sequence, the conveyor will be loaded with an initial scrap bed length of approximately 15 feet leaving 6 feet of conveyor free. Accordingly, 3 number of advance cycles spread evenly over the 10 minute preheating cycle will be required to advance the scrap to the discharge end of the conveyor.

The scrap preheating system of the present invention has been described in respect to a particular embodiment thereof shown in the drawings. It is, however, to be understood that other variations and modifications of the system disclosed may be made without departing from the scope and spirit of the claims.

We claim:

1. In a scrap preheating system including a conveyor on which the scrap to be preheated is positioned, enclosure means positioned over the conveyor and burner means associated with the enclosure means for directing flames upon the scrap, the improvements for eliminating unburned hydrocarbons comprising:

an elongate exhaust chamber extending along and adjacent the enclosure means;

communication means providing communication between the enclosure means and the exhaust means generally along the length thereof;

air bleeding means for introducing air to the exhaust chamber generally along the length thereof; and exhaust means for inducing a negative pressure within the exhaust chamber for drawing the unburned hydrocarbons through the exhaust chamber wherein they are mixed with the air and burned.

2. The preheating system of claim 1 wherein the enclosure means includes side walls adjacent the conveyor and wherein the communication means includes a plurality of side wall ports positioned in at least one side wall and in communication with the exhaust chamber through which the unburned hydrocarbons are drawn.

3. The scrap preheating system of claim 2 wherein the exhaust chamber is co-extensive with the side wall of the enclosure means and the side wall thereof forms a common wall between the enclosure means and exhaust chamber.

4. The scrap preheating system of claim 2 wherein the side walls of the enclosure means are spaced from the conveyor means permitting air to be drawn into the side wall ports to support combustion of the unburned hydrocarbons within the exhaust chamber.

5. The scrap preheatng system of claim 2 further including cooling air bleeding means positioned between the exhaust chamber and the exhaust means for introducing cooling air to cool the products of combustion to protect the exhaust means.

6. A scrap metal preheating system comprising:

an elongate conveyor upon which the scrap to be preheated is positioned;

an elongate burner hood including a cover and parallel side walls positioned in enclosing relationship above the conveyor;

burner means positioned within the hood for directing flames upon the scrap;

an elongate exhaust chamber formed within at least one of the side walls of the hood;

means for introducing air to the exhaust chamber;

a plurality of exhaust ports through the side wall in communication with the exhaust chamber; and exhaust means for producing a negative pressure within the exhaust chamber to draw the gases within the hood through the exhaust chamber to complete combustion of unburned hydrocarbons within the exhaust chamber as they mix with the air.

7. The scrap preheating system of claim 6 wherein the means for introducing air to the exhaust chamber is formed by the side walls of the hood being spaced from the conveyor to permit passage of air between the side walls and the conveyor to the exhaust ports in the side walls.

* * * * *